US007100665B2

(12) United States Patent
Miller

(10) Patent No.: US 7,100,665 B2
(45) Date of Patent: Sep. 5, 2006

(54) DUAL BOSS SHUTTER SLAT WITH RETENTION PLATE

(76) Inventor: James V. Miller, 893 N. Maryknoll Cir., Glen Ellyn, IL (US) 60137

( * ) Notice: Subject to any disclaimer, the term of this patent is extended or adjusted under 35 U.S.C. 154(b) by 93 days.

(21) Appl. No.: 10/802,257

(22) Filed: Mar. 17, 2004

(65) Prior Publication Data

US 2005/0205221 A1 Sep. 22, 2005

(51) Int. Cl.
*E06B 3/06* (2006.01)

(52) U.S. Cl. ..... 160/235; 160/133; 160/201

(58) Field of Classification Search ..... 160/235, 160/236, 183, 133, 201
See application file for complete search history.

(56) References Cited

U.S. PATENT DOCUMENTS

| | | | |
|---|---|---|---|
| 638,314 | A | 12/1899 | Blades |
| 845,526 | A | 2/1907 | Collins |
| 876,593 | A | 1/1908 | Rush |
| 1,014,315 | A | 1/1912 | McCloud |
| 1,352,656 | A | 9/1920 | Cahill |
| 1,579,839 | A | 4/1926 | Raper |
| 1,776,119 | A | 9/1930 | Johnson |
| 1,892,570 | A | 12/1932 | Ginder |
| 1,918,415 | A | 7/1933 | Miller |
| 2,350,287 | A | 5/1944 | Michelman |
| 2,545,400 | A | 3/1951 | White |
| 2,812,813 | A | 11/1957 | Zarnowski |
| 2,858,883 | A | 11/1958 | Rapin |
| 3,292,685 | A | 12/1966 | Clark |
| 3,431,964 | A | 3/1969 | Rogers |
| 3,489,200 | A | 1/1970 | Recchione |
| 3,670,797 | A | 6/1972 | Sassano |
| 4,037,639 | A | 7/1977 | Jones |
| 4,294,302 | A | 10/1981 | Ricke, Sr. |
| 4,332,287 | A | 6/1982 | Stolpe |
| 4,343,340 | A | 8/1982 | Paule |
| 4,345,635 | A | 8/1982 | Solomon |
| 4,379,479 | A | 4/1983 | Whiting |
| 4,386,645 | A | 6/1983 | Dever et al. |
| 4,519,434 | A | 5/1985 | Forquer |
| 4,611,848 | A | 9/1986 | Romano |
| 4,628,982 | A | 12/1986 | Labelle |
| 4,690,193 | A | 9/1987 | Morrison et al. |
| 4,718,472 | A | 1/1988 | Hormann |
| 4,723,588 | A | 2/1988 | Ruppel |
| 4,738,296 | A | 4/1988 | Hatch |
| 4,795,206 | A | 1/1989 | Adams |
| 4,807,687 | A | 2/1989 | Finch et al. |
| 4,929,862 | A | 5/1990 | Hamilton et al. |
| 4,930,563 | A | 6/1990 | Finch et al. |
| 5,070,925 | A | 12/1991 | Paule |
| 5,154,468 | A | 10/1992 | Teigen et al. |
| 5,165,746 | A | 11/1992 | Teigen |
| 5,204,147 | A | 4/1993 | Schneider |

(Continued)

OTHER PUBLICATIONS

Lakal Rolladensysteme, Lakel Profil AHS 75 brochure, 4 pages—undated prior art.

(Continued)

*Primary Examiner*—Blair M. Johnson
(74) *Attorney, Agent, or Firm*—Ice Miller LLP

(57) ABSTRACT

A rolling shutter and a slat for use in a rolling shutter are provided. The slat comprises a first receptacle and a second receptacle, wherein each receptacle is c-shaped and adapted to receive a retention screw, and wherein each receptacle projects from one or more of interior surfaces of the shutter slat.

6 Claims, 7 Drawing Sheets

U.S. PATENT DOCUMENTS

| | | | | |
|---|---|---|---|---|
| 5,209,281 | A | 5/1993 | Kraeutler | |
| 5,253,694 | A | 10/1993 | Bernardo | |
| 5,265,663 | A | 11/1993 | Munekata et al. | |
| 5,343,924 | A | 9/1994 | Hoffman | |
| 5,365,990 | A | 11/1994 | Ueda | |
| 5,372,175 | A | 12/1994 | Calhoun et al. | |
| 5,377,738 | A | 1/1995 | Cooper | |
| 5,426,893 | A | 6/1995 | Hoffman | |
| 5,469,905 | A | 11/1995 | McKinney et al. | |
| 5,482,104 | A | 1/1996 | Lichy | |
| 5,575,322 | A | 11/1996 | Miller | |
| 5,586,592 | A | 12/1996 | McGregor | |
| 5,601,130 | A | 2/1997 | Werner et al. | |
| 5,611,383 | A | 3/1997 | Hoffman | |
| 5,613,539 | A | 3/1997 | Kraler | |
| 5,657,805 | A | 8/1997 | Magro | |
| 5,682,937 | A | 11/1997 | Decrane et al. | |
| 5,839,493 | A | 11/1998 | Quasius | |
| 5,850,862 | A | 12/1998 | Miller | |
| 5,996,669 | A | 12/1999 | Miller | |
| 6,085,822 | A | 7/2000 | Miller | |
| 6,095,225 | A | 8/2000 | Miller | |
| 6,129,132 | A * | 10/2000 | Denoual et al. | 160/235 |
| 6,422,289 | B1 | 7/2002 | Miller | |
| 6,631,749 | B1 | 10/2003 | Zabata | |
| 2004/0188037 | A1 * | 9/2004 | Schlater et al. | 160/133 |

OTHER PUBLICATIONS

SIRO Safety Roller Blind brochure 4 pages—prior art.

Sweet's General Building & Renovation 1993 Catalog File, Rollaway Insulating Security Shutters, Roll-A-Way, #B500, 8 pages.

Sweet's General Building & Renovation 1993 Catalog File, QMI Roll Shutter Supply, "BuyLine 6925" 4 pages.

Sweet's General Building & Renovation 1993 Catalog File, Solaroll, Solaroll Shade & Shutter Corporation, Catalog 561, #B505, 44 pages.

Sweet's General Building & Renovation 1993 Catalog File, Rolladen Rollshutters, Rolladen Inc., #B499, 8 pages.

Sweet's General Building & Renovation 1993 Catalog File, Hurst Shutters Accordion Shutters/Removable Shutters, Hurst Awning Company, Inc. #B492, 8 pages.

Sweet's General Building & Renovation 1993 Catalog File, Enviroblind Exterior Rolling Shutters, Environmental Seal and Security Co., Inc. #B489, 4 pages.

* cited by examiner

DUAL BOSS SHUTTER SLAT WITH RETENTION PLATE

BACKGROUND OF THE INVENTION

1. Field of the Invention

The present invention relates to shutters and in particular to shutters of the roller type having improved resistance to storms and break-ins. Furthermore, this invention relates to a shutter having improved retraction capability.

2. Description of the Related Art

Conventional roller shutters are designed to provide security from break-ins or protection from storms. The shutters must maintain appropriate structural integrity while extended in order to provide security and protection, but the design of a roller shutter must also allow a user to conveniently extend or retract the shutter on demand. Even though conventional roller shutters may need to be extended and retracted frequently or unexpectedly, such shutters have been prone to jam and/or snag. In addition, various factors influence the strength of a shutter and its ability to withstand forces of nature and attempts by intruders to break in through the aperture enclosed by the shutter. The material choice for fabrication of the shutter is one such factor, as is the type of articulation between shutter slats. In addition, a shutter may be strengthened by increasing surface area contact of each shutter slat with a guard, typically a track that runs the full length of the building aperture covered by the shutter. Unfortunately, this surface area is limited by the requirement that the slats of a roller shutter must be capable of conforming to a roll, for convenient storage.

One such conventional roller shutter employs a single c-shaped boss located inside the hollow body of the shutter, into which a retaining screw may be inserted. The retaining screw then holds the slat in a fixed position within the guard, allowing the roller shutter to slide up and down the guard during retraction and extension, respectively, while purportedly preventing the roller shutter from undesirably disengaging from the guards. This shutter differs from the present invention because it bears only a single boss and does not employ a retention plate.

One result of this configuration is that the individual shutter slats easily jam during extension and retraction of the shutter. The single retention screw provided in each shutter slat allows the slat to wiggle undesirably within the guard, particularly when the articulation between slats is loose or when there is otherwise play between slats.

U.S. Pat. No. 6,631,749 to Zabala teaches a roller shutter in which each slat has one or more transverse ribs for support, as well as two sets of internal brackets running the length of the slat, in which retainers, or retaining screws, are disposed. The retainers of each slat slide along the guard assembly as the roller shutter is extended and retracted, and provide support to the roller shutter by restricting the motion of the slats. The '749 patent is different from the present invention because it requires support ribs that are separate and distinct from the brackets into which the retainers are received. Furthermore, the '749 patent does not teach or employ a retention plate to maximize surface area contact between the shutter slat and the guard.

OBJECTS OF THE INVENTION

A first object of the invention is to improve the stability of the roller shutter while it is in an extended position, maximizing the protection provided by the roller shutter while minimizing manufacturing complexity.

A second object of the invention is to improve the smoothness with which the roller shutter may be extended and retracted.

A third object of the invention is to satisfy the above listed objects of the invention without sacrificing the ability of the roller shutter to be rolled up compactly for storage.

These and other objects of the present invention will become apparent upon further review of the following specification and drawings.

SUMMARY OF THE INVENTION

According to the present invention, increased stability as well as smooth extension and retraction of the roller shutter may be achieved without the aforementioned undesirable features of prior art by increasing the surface contact between the shutter slat and the guide. The increase in surface contact is accomplished by use of a dual-boss shutter slat in combination with a retention plate, wherein the retention plate is secured to each shutter slat by means of identically sized screws inserted into each of the two bosses in the shutter slat. The configuration of the shutter slats and the retention plate contemplated by the present invention does not impede the roller shutter from retracting into a compact roll.

There is provided a shutter for a building aperture comprising a plurality of such shutter slats each having an upper and lower edge, a first face and a second face, and a first end and a second end, which are articulated to form a roller shutter having a first face and a second face, and a first end and a second end. The shutter further comprises first and second guides, which are locatable at the first and second ends of the roller shutter.

According to a first aspect of the present invention, each boss provides a c-shaped receptacle for a retention screw. Each boss, provided inside the generally hollow interior of a shutter slat, runs from the first end to the second end of the shutter slat. Other than the single aperture provided in the c-shape, the boss is continuous in internal profile.

In a first embodiment of the present invention, the two bosses project into the generally hollow interior of the slat from the interior surfaces corresponding to the upper and lower edges.

In a second embodiment of the present invention, each boss spans the interior distance of the generally hollow slat, from the first face to the second face, thereby providing added stability without the need for a separate support rib. The use of a pair of identically sized, gap-spanning bosses allows desirable reduction in manufacturing complexity in the present invention over the prior art.

According to another aspect of the invention, a retention plate is used in combination with the dual-boss shutter slat. In one embodiment, the retention plate has holes corresponding in size and alignment to the two bosses of the shutter slat. In this embodiment, the dimensions of the retention plate must not exceed those of the profile of the shutter slat, to ensure that the roller shutter may be rolled up compactly.

In another embodiment, the retention plate has elongated holes corresponding in alignment to the two bosses of the slat, which allow incidental movement of the plate upon retraction of the shutter. In this embodiment, the retention plate may be wider than the thickness of the shutter slat, allowing increased surface area contact between the shutter slat and the guide without detriment to the compactness of the retracted shutter.

BRIEF DESCRIPTION OF THE DRAWINGS

Embodiments of the invention will now be explained in further detail by way of example only with reference to the accompanying figures in which.

DETAILED DESCRIPTION

Figure 1:
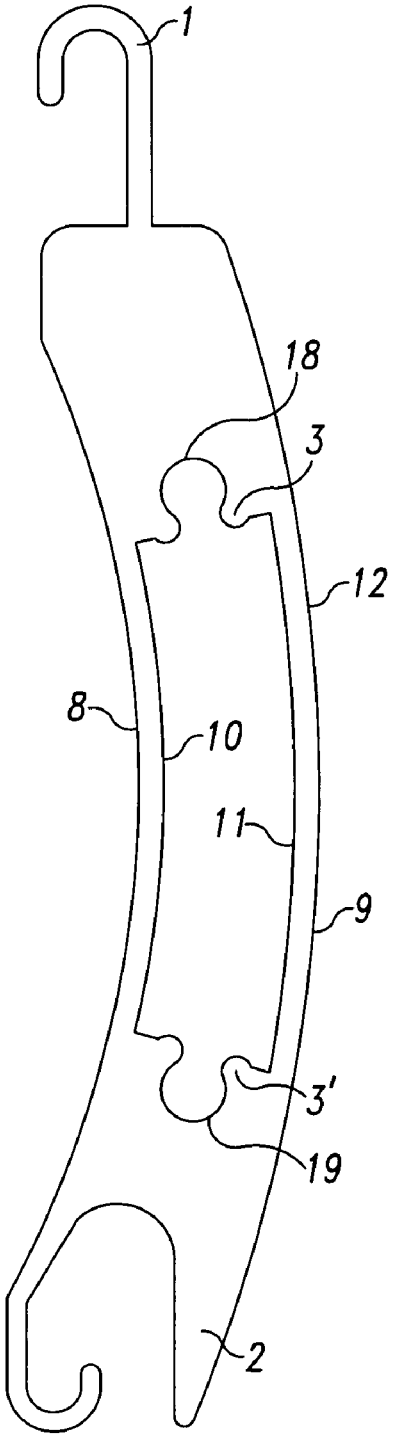
FIG. 1 is a side view of a dual-boss shutter slat according to the present invention.

FIG. 1 illustrates a first embodiment of the present invention, a side view of a dual boss shutter slat 12. According to the embodiment depicted in FIG. 1, shutter slat 12 is a generally hollow, elongated body of extruded aluminum having a first face 9 and a second face 8, and an upper edge 1 and a lower edge 2. The upper edge 1 comprises a track having a hook-shaped profile adapted to cooperate with the lower edge 2 of an identical slat, also comprising a track having a hook-shaped profile. The hollow interior of the slat is defined by the interior surfaces of the first and second faces, 11 and 10 respectively, and the interior surfaces of the upper and lower edges, 18 and 19 respectively. Shutter slat 12 also has a first end X and a second end Y, not shown in FIG. 1.

The shutter slat 12 shown in FIG. 1 further includes two bosses, 3 and 3' which project into the generally hollow interior of the shutter slat 12 and run the length of the shutter slat 12, from the first end X to the second end Y (not shown). In the embodiment depicted in FIG. 1, a first boss 3 projects from the interior surface of the upper edge 18, and a second boss 3' projects from the interior surface of the lower edge 19. Each boss 3 and 3' has a roughly c-shaped internal profile. In this embodiment, the first and second bosses 3 and 3' may either project directly from the interiors of the upper and lower surfaces, 18 and 19 respectively, or they may project generally from the junctions of the upper and lower surfaces 18 and 19 with the interiors of the first and second faces 11 and 10.

Figure 2:
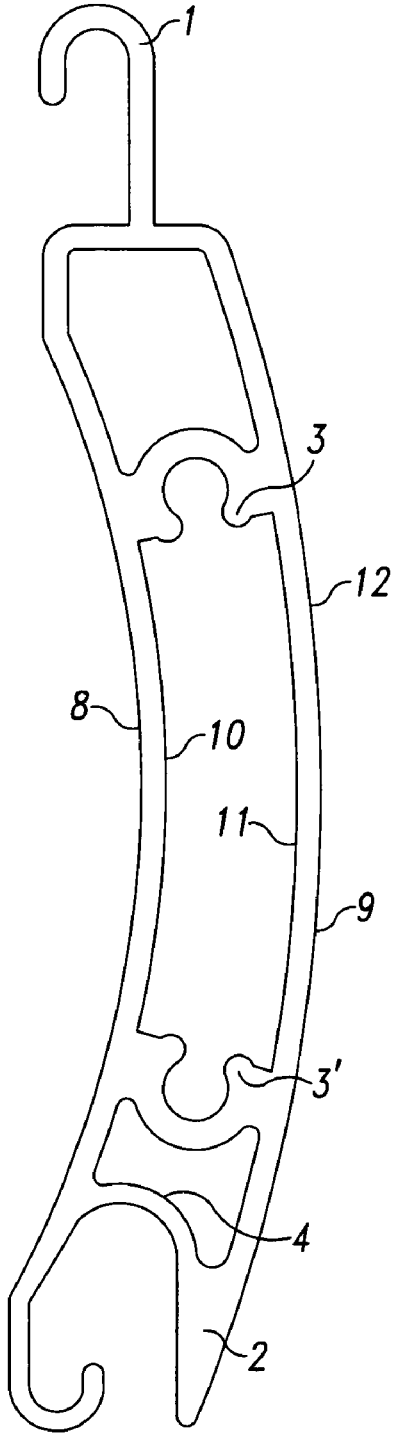
FIG. 2 is a side view of a second embodiment of a dual-boss shutter slat.

FIG. 2 illustrates a side view of a second embodiment of a shutter slat 12 according to the present invention. In this embodiment, bosses 3 and 3' extend from the interior surface of the first face 11 to the interior surface of the second face 10. In this embodiment, a first boss 3 comprises a downward-opening projection having a c-shaped profile. The second boss 3' is located between the first boss 3 and the interior surface of the lower edge 19 and comprises an upward-opening projection having a c-shaped profile. Three chambers are formed inside the generally hollow shutter slat 12 of the second embodiment as compared to the single interior chamber of the first embodiment. It is to be understood that the first boss 3 and the second boss 3' could, in the alternate, open upward and downward, respectively, or they could both open downward or both upward.

Figure 8:
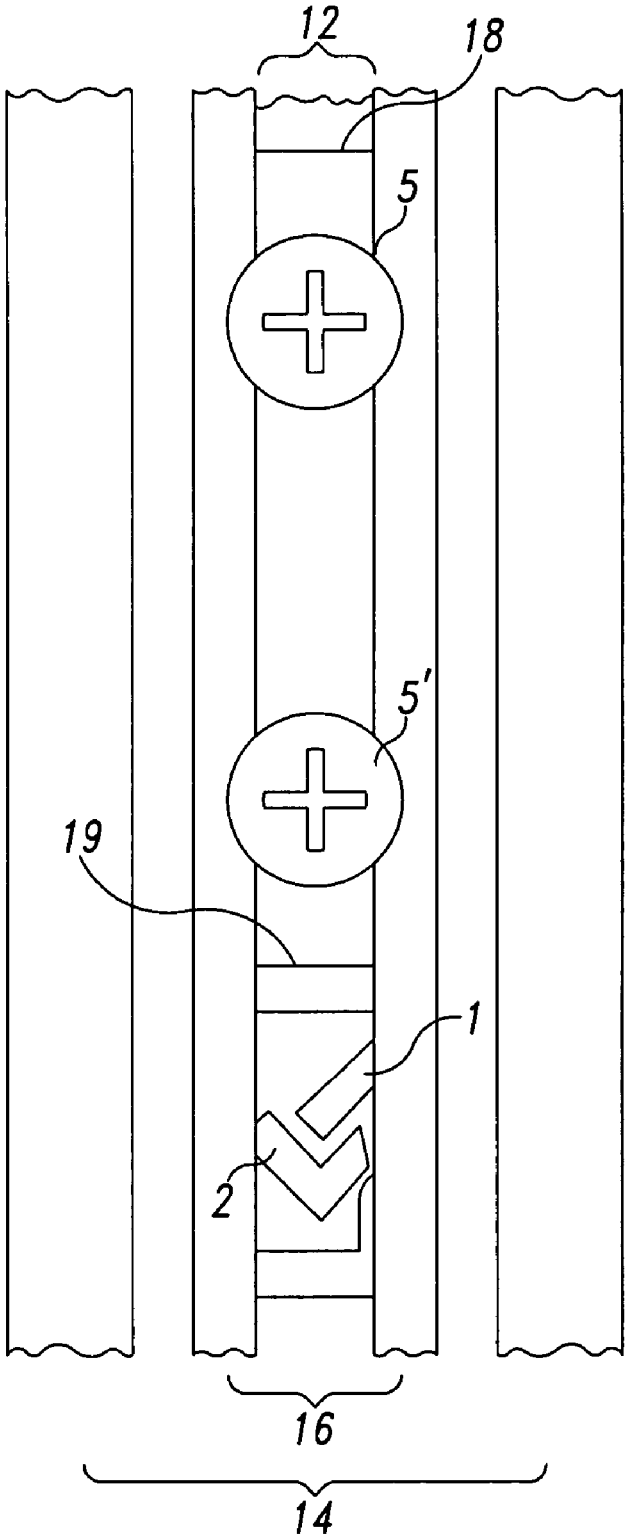
FIG. 8 is a detailed cross-sectional view of a dual-boss shutter slat according to the present invention.
Figure 9:
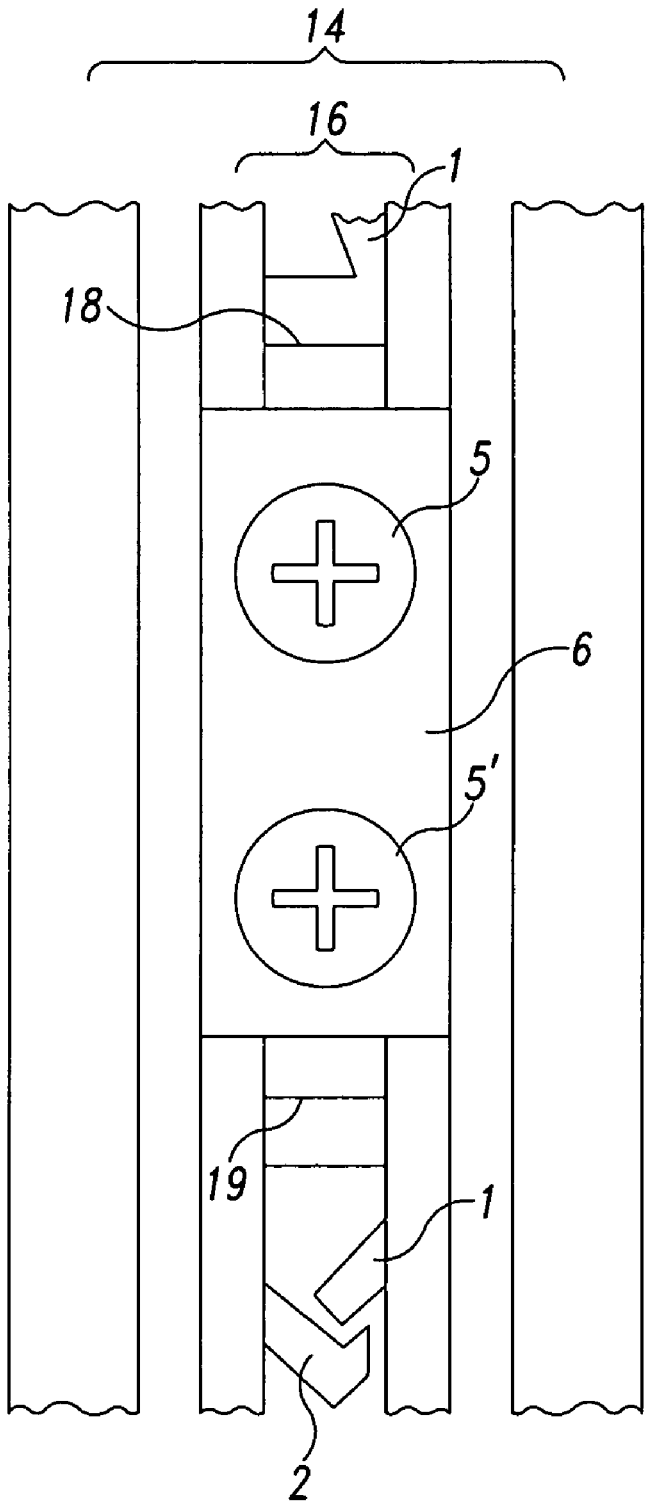
FIG. 9 is a detailed cross-sectional view of a dual-boss shutter slat in combination with a first embodiment of a retention plate according to the present invention.

FIG. 8 is a partial sectional view according to the second embodiment of the present invention. Retaining screws 5 and 5' are depicted in combination with guide 14 and shutter slat 12. The heads of retention screws 5 and 5' cooperate with guide 14 at the internal rib 16. In both the first and second embodiments, shown in FIG. 1 and FIG. 2, respectively, retention screws 5 and 5' are received into bosses 3 and 3' respectively (not shown). When screws 5 and 5' are received into bosses 3 and 3' at each end of shutter slat 12, the combination assists in retaining the shutter slat 12 along a guide 13, 14. In this configuration, additional surface contact is provided over single-retainer prior art devices.

An advantage of the second embodiment of the present invention over other dual-screw configurations is that in spanning the interior of the slat, bosses 3 and 3' of the second embodiment of the present invention provide what the prior art device required an additional support member to accomplish. In addition, by reinforcing the interior-spanning boss with the retention screw, the resulting combination is stronger and more secure than a single layer of extruded metal found in the support member of the prior art.

It is also to be understood that a shutter slat could be made employing a boss of the first embodiment and a boss of the second embodiment, and that more than two bosses could be employed in any combination of the first and second embodiments described herein in keeping with the present invention.

Figure 4:
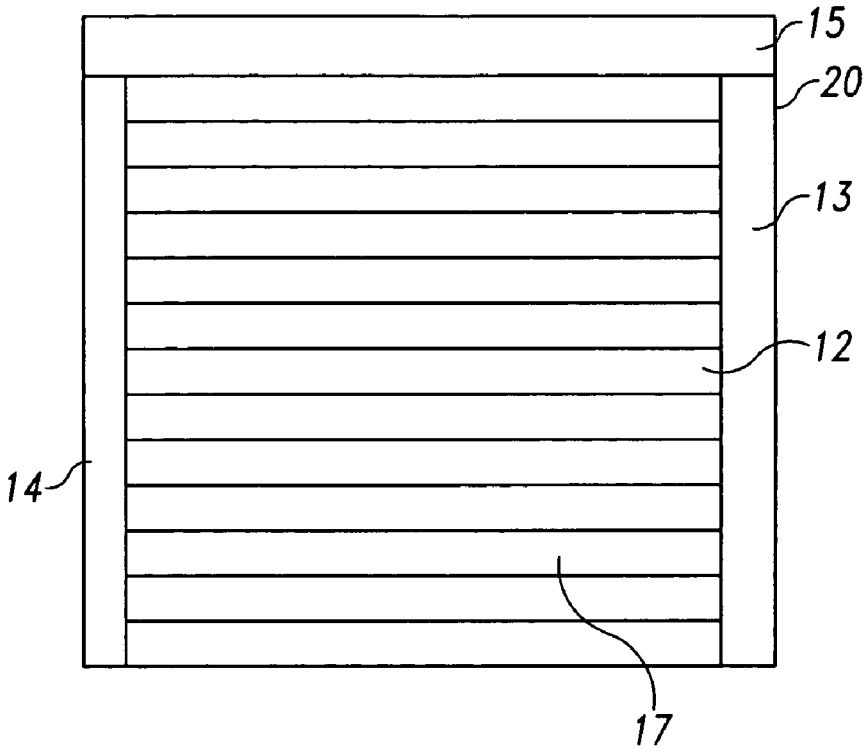
FIG. 4 is an elevation of a window aperture including a roller shutter according to a first embodiment of the invention.

FIG. 4 illustrates an elevation of a roller shutter according to the present invention, applied to a building aperture 20. Roller shutter 17 may be installed on a building aperture 20 such as a window or door or any other aperture requiring closure for safety or convenience purposes. Details of building aperture 20 are not illustrated for the sake of clarity. Shutter slat 12 is shown as it is intended to operate: as one of a plurality of shutter slats 12, which are articulated to form a roller shutter 17. Building aperture 20 is further provided with a shutter casing 15 and a pair of guides 13 and 14, located on opposite lateral edges of building aperture 20. Roller shutter 17 may be rolled up within shutter casing 15 for storage.

Figure 3:
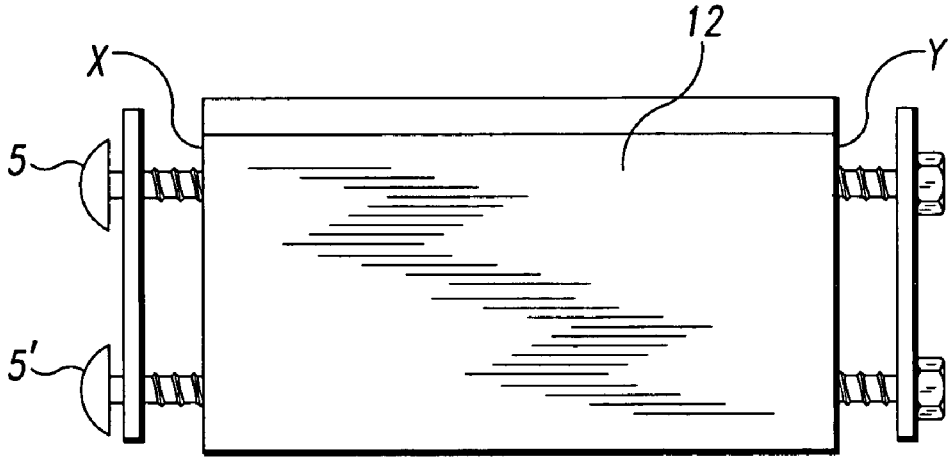
FIG. 3 is a partial elevation of a shutter slat including a retention plate according to the present invention.
Figure 3A:
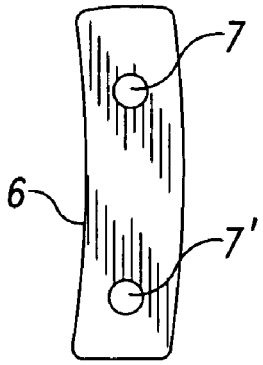
FIG. 3*a* is an elevation of a retention plate for use with a shutter slat.

FIG. 3 illustrates a partial elevation of a third embodiment of the present invention. Retention screws 5 and 5,' engaged with bosses 3 and 3' (not shown) are disposed at ends X and Y of shutter slat 12. According to a second aspect of the present invention, shutter slat 12 is further provided with a retention plate 6 located at end Y. One or more retention plates 6 may be used in conjunction with a shutter slat 12 and retention screws 5 and 5'. As shown in FIG. 3*a*, an elevation of retention plate 6, retention plate 6 is typically a flat plate having two apertures 7 and 7' adapted to receive the retention screws 5 and 5'. Although a rectangular shape is shown, a retention plate 6 could have any number of shapes including round, oblong, oval, trapezoidal, or other geometric shape. In a particularly preferred embodiment, one retention plate 6 and one set of retention screws 5 and 5' are used in combination with a first end X of the shutter slat 12, and a second retention plate 6 and set of retention screws 5 and 5' are used in combination with a second end Y of the shutter slat 12.

Figure 6:
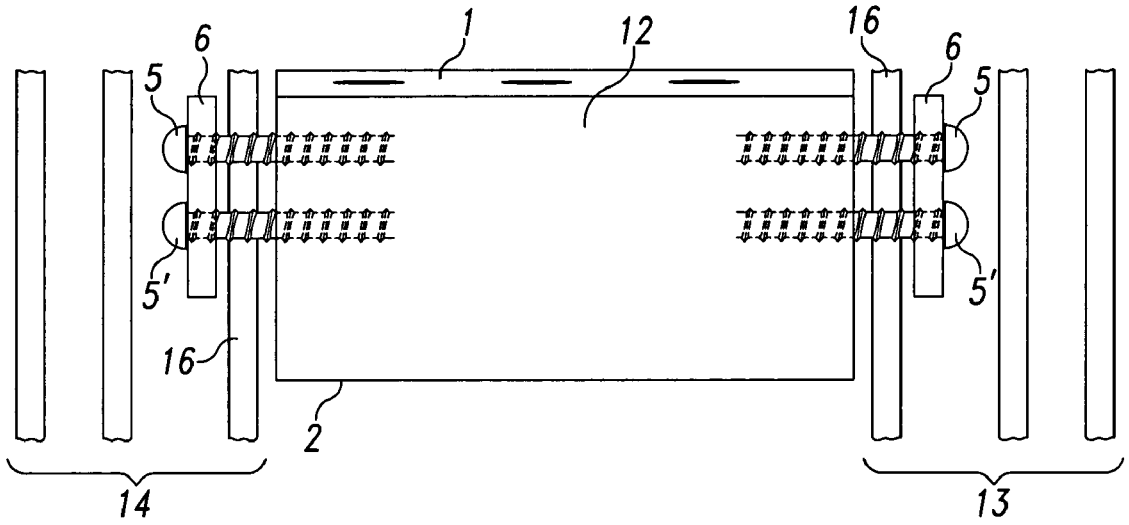
FIG. 6 is a partial vertical sectional view of a shutter slat in combination with a retention plate according to the present invention.
Figure 7:
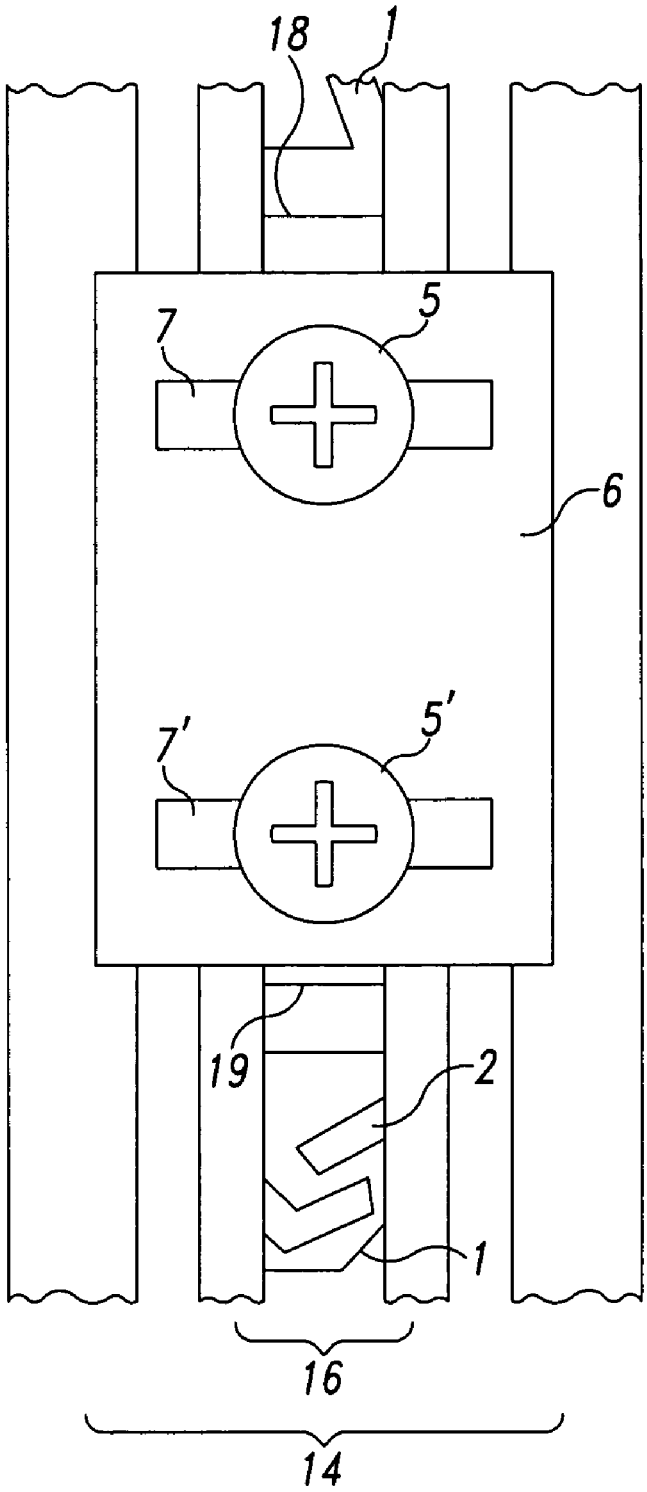
FIG. 7 is a detailed cross-sectional view of a dual-boss shutter slat in combination with a second embodiment of a retention plate according to the present invention.

As shown in FIG. 6, a partial sectional view according to this embodiment of the invention, a shutter slat 12 having upper edge 1 and lower edge 2 is shown in combination with guides 13 and 14, and with two retention plates 6 and two sets of retention screws 5 and 5'. One retention plate 6 and one set of retention screws 5 and 5' are located at the first end X of shutter slat 12, and a second retention plate 6 and set of retention screws 5 and 5' are located at second end Y. Retention screws 5 and 5' are threaded through the retention plate 6 at apertures 7 and 7' respectively (not shown) before being inserted into the shutter slat 12 at bosses 3 and 3' (not shown). The retention screws 5 and 5' are tightened into the bosses 3 and 3' as desired, allowing sufficient clearance between the retention plate 6 and the end X or Y of the shutter slat 12 for the retention plate 6 to slide freely within the guide 14. The retention plate 6 facilitates the movement of the shutter slat 12 along guides 13 and 14.

The benefit of the retention plate 6 is that a greater surface area is provided for contact with internal rib 16, resulting in smoother motion of the roller shutter 17 up and down the guides 13 and 14 with less jamming. An additional benefit of the retention plate 6 is that if the exertion of pressure on the first face 9 or second face 8 of the roller shutter 17 deflects the roller shutter 17 in one direction or another, the retention plate 6 may more firmly engage the guides 13 and 14 thereby distributing the force over the full face of the retention plate 6 instead of merely the retention screws 5 and 5'. The retention screws 5 and 5' will therefore be less likely to be damaged and the roller shutter itself will be more resistant to damage.

An elevation of a retention plate 6 is shown in FIG. 3*a*. In one embodiment of the retention plate 6, shown in FIG. 3*a*, the retention plate 6 has apertures 7 and 7' which are round or otherwise adapted to receive screws 5 and 5' firmly, without significant play or clearance for incidental movement. In this embodiment, the width of the retention plate 6 is restricted to the thickness of the shutter slat 12 from the first face 9 to the second face 8. If the width of the retention plate 6 exceeds this dimension, retraction of the roller shutter 17 will be hampered by the interference of the retention plates 6 at the ends X and Y of shutter slats 12. That is, in normal retraction of the roller shutter 17, the shutter slats 12 pivot at their articulations to form a roll, wherein the shutter slats 12 of outer layers of the roll rest on the shutter slats 12 of the next inner layer. In this way, the weight of each slat is distributed over the length of the slat beneath it. If a retention plate according to this embodiment is wider than the thickness of the shutter slat, upon retraction of the shutter the slats can no longer rest evenly upon one another. Instead the entire weight of a slat would rest upon the retention plate and retention screws of the slat below it, providing stress that could break the retention plate and screws or result or undesirable bending of the slat.

Figure 3B:
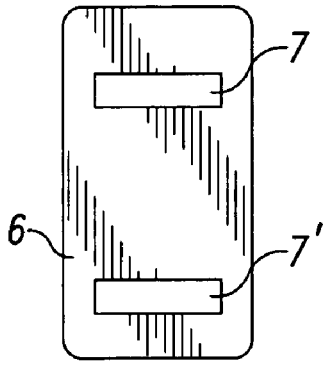
FIG. 3*b* is a variation of the retention plate shown in FIG. 3*a;*

FIG. 3*b* depicts an elevation of a second embodiment of retention plate 6. In a second embodiment, retention plate 6 has apertures 7 and 7' which are oblong or laterally elongated. The elongated apertures 7 and 7' shown in FIG. 3*b* are designed to allow a desired amount of play or incidental movement between the screws 5 and 5' and the retention plate 6. This embodiment of the retention plate 6 is not restricted in width to the thickness of the shutter slat 12 from the first face 9 to the second face 8. Play or incidental movement between the screws and the retention plate allows the retention plates to slide out of the way when the roller shutter 17 is retracted into shutter casing 15, thereby avoiding excessive pressure on the retention plate and retention screws described above.

Figure 5:
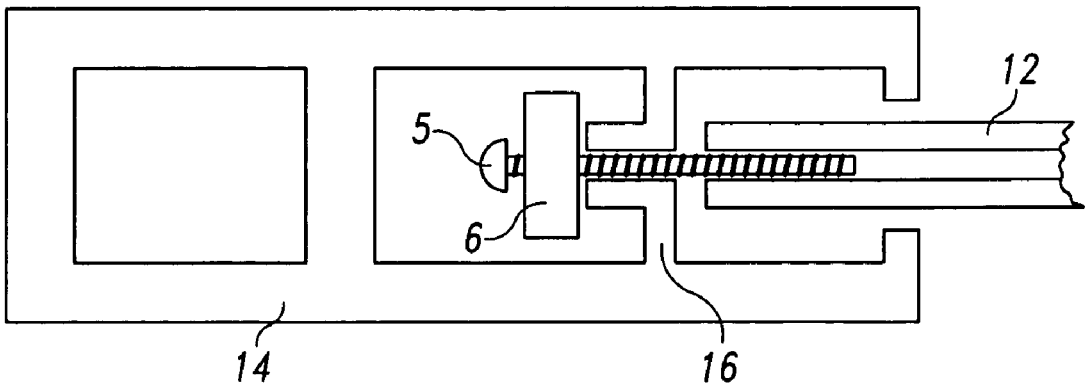
FIG. 5 is a partial horizontal sectional view of a retention plate according to the invention.

FIG. 5 is a partial sectional view of a shutter slat 12 in combination with a retention plate 6. In FIG. 5, a shutter slat 12 in combination with a retention plate 6 is engaged within a guide 14. Retention screws 5 and 5' (not shown) secure retention plate 6 within the bosses 3 and 3' (not shown) of retention plate 12.

Many further modifications in addition to those described above may be made to the structures and techniques described herein without departing from the spirit and scope of the invention. Accordingly, although specific embodiments have been described, these are examples only and are not limiting upon the scope of the invention.

I claim:

1. A shutter slat, comprising:

A hollow elongated body portion having a first end and a second end, an upper edge and a lower edge, a first exterior face and a second exterior face, and a hollow interior defined by an upper interior surface, a lower interior surface, a first interior surface, and a second interior surface;

a first receptacle and a second receptacle, wherein each receptacle comprises a c-shaped receptacle adapted to receive a retention screw, and wherein each receptacle projects from one or more of said interior surfaces; and a retention plate having a first aperture and a second aperture, wherein the retention plate is located a first distance away from the first end of the body portion and secured to the first end by a first screw extending through the first aperture and coupled to the first receptacle and a second screw extending through the second aperture and coupled to the second receptacle;

wherein said upper edge comprises a track having a hook shaped profile and running the length of said slat;

wherein said lower edge comprises a track having a hook shaped profile and running the length of said slat;

wherein said upper edge is adapted to cooperate with said lower edge whereby multiple identical slats may be articulated to form a roller shutter.

2. A shutter slat according to claim 1, wherein said first receptacle projects from said upper interior surface.

3. A shutter slat according to claim 1, wherein said first receptacle projects generally from the junction of said upper interior surface and said first interior surface or said second interior surface.

4. A shutter slat according to claim 1, wherein said second receptacle projects from said lower interior surface.

5. A shutter slat according to claim 1, wherein said second receptacle projects generally from the junction of said lower interior surface and said first interior surface or said second interior surface.

6. A rolling shutter, comprising:

a shutter slat comprising:

an elongated body portion having a first end and a second end;

a channel extending from the first end to the second end;

and a first receptacle and a second receptacle coupled to the body, located in the channel adjacent to the first end, wherein each receptacle has a profile that extends along an arc;

a guide comprising a hollow elongated body portion having a first end and a second end, wherein a first channel, a second channel, and a slot extend longitudinally through the hollow elongated body portion, wherein the fist channel is in fluid communication with the second channel via the slot; and a retention plate having a first aperture and a second aperture, wherein the retention plate is located in the first channel;

wherein the first end of the elongated body portion of the shutter slat is located in the second channel, and the retention plate is secured to the first end by a first screw extending through the first aperture, through the slot, and coupled to the first receptacle and a second screw extending through the second aperture, through the slot, and coupled to the second receptacle.

* * * * *